US006363642B1

(12) United States Patent
Johnson et al.

(10) Patent No.: US 6,363,642 B1
(45) Date of Patent: Apr. 2, 2002

(54) APPARATUS AND METHOD FOR SIMULATING THE APPEARANCE OF WHEELS

(75) Inventors: Andrew Johnson, Portland; Mike McHorse, Tigard, both of OR (US)

(73) Assignee: Throttle Corporation, Portland, OR (US)

( * ) Notice: Subject to any disclaimer, the term of this patent is extended or adjusted under 35 U.S.C. 154(b) by 0 days.

(21) Appl. No.: 09/527,063

(22) Filed: Mar. 16, 2000

(51) Int. Cl.[7] ..... G09F 21/04
(52) U.S. Cl. ..... 40/587; 40/538
(58) Field of Search ..... 40/538, 587, 606, 40/617

(56) References Cited

U.S. PATENT DOCUMENTS

| | | | | | |
|---|---|---|---|---|---|
| 1,948,578 | A | * | 2/1934 | Halsey | 40/538 |
| 2,503,988 | A | | 4/1950 | Arbib | |
| 2,759,282 | A | | 8/1956 | Lecourt | |
| 3,141,252 | A | * | 7/1964 | Mullen | 40/538 |
| 3,864,860 | A | | 2/1975 | Merzweiler | |
| 3,918,186 | A | * | 11/1975 | Gray | 40/587 |
| 4,058,917 | A | | 11/1977 | Tallon | |
| 4,388,771 | A | | 6/1983 | Lalonde | |
| 4,422,633 | A | * | 12/1983 | Petrone | 272/8 N |
| 4,940,195 | A | | 7/1990 | Jackson | |
| 5,072,536 | A | * | 12/1991 | Matthews et al. | 40/587 |
| D387,581 | S | * | 12/1997 | Parker et al. | D6/466 |
| 6,120,104 | A | * | 9/2000 | Okamoto et al. | 40/587 |

OTHER PUBLICATIONS

Various pages printed from www.tirerack.com on May 16, 2000; showing 1999 Ford pickup truck with 2 different wheels. System circa 1998.

* cited by examiner

*Primary Examiner*—Lynne H. Browne
*Assistant Examiner*—Kenn Thompson
(74) *Attorney, Agent, or Firm*—ipsolon llp

(57) ABSTRACT

An apparatus and method for simulating the way that selected custom wheels will appear on a vehicle. The method involves creating high quality graphic reproductions of actual commercially available custom wheels and tires in the form of a wheel disc approximating the size of an actual tire and wheel combination. The selected wheel disc is then positioned adjacent a car tire to simulate the appearance of the car with the selected wheel mounted thereon. A plurality of the wheel/tire discs is in one embodiment held on a portable support stand. In an alternate embodiment plural wheel discs are mounted to separate tire rings representing tires of various sizes.

16 Claims, 3 Drawing Sheets

APPARATUS AND METHOD FOR SIMULATING THE APPEARANCE OF WHEELS

FIELD OF THE INVENTION

This invention relates to an apparatus and system for simulating the appearance of a variety of custom wheels on land vehicles.

BACKGROUND AND SUMMARY OF THE INVENTION

The overall appearance and performance of any land vehicle can be greatly influenced by the wheels that are used with it. The wheels even arguably may have a greater impact on the appearance of a vehicle than any other single factor. It is not surprising, therefore, that there is an enormous demand for custom wheels for all sorts of vehicles, from light cars and trucks to heavy trucks and trailers of all kinds. For example, it is not unusual for an automobile enthusiast to purchase custom wheels for his or her car after growing fired of the original wheels that came with the car when it was purchased. It also is not unusual for a car lover to purchase more than one set of wheels for his or her car.

Wheel manufacturers long ago recognized the demand for custom wheels, and there exist today many, many manufacturers of after-market custom wheels. Most of these manufacturers produce a wide variety of wheels, with each wheel having a unique appearance. A trip to any retail wheel and tire dealer will illustrate the vast variety of wheel styles that are available for any given vehicle. The result of this manufacturing variety is that consumers have literally hundreds of wheel styles to choose from when making a wheel-buying decision.

But if the great selection of wheels that are available to consumers results in ample consumer choices, it also causes problems for both the consumer and the wheel dealer. For the consumer, a major issue is how a particular wheel style will look on his or her car. Most consumers that purchase custom after-market wheels make their purchasing decision based in large part on the way that the wheels look on their car. The selection of a wheel is a very personal process. And like most consumer decisions of this nature, beauty is truly in the eye of the beholder. The subjective nature of the process is of course is part of the reason why wheel suppliers manufacture such a wide variety of wheel styles—different consumers prefer wheels of different styles. But it is very difficult for a consumer to visualize how his or her car will appear based on looking at a wheel hung on the wall of a tire and wheel dealer's showroom. It is no less difficult to visualize the appearance of the consumer's car with new wheels when the wheel is positioned next to the consumer's car.

Since wheel preference is a very subjective matter, the only really effective manner in which to visualize how a car will look with new wheels is to "try them on." This is akin, in a sense, to a consumer trying on a new suit. The consumer can't really know how he or she will look in the new suit until he or she puts it on.

But trying a wheel on a car to see how it will look is far different from trying on a new suit to see how it will look, and it is not an activity that most wheel dealers are willing to entertain. Indeed, wheel dealers are reluctant, at best, to even consider lefting a consumer mount a set of wheels on his or her car just to see how they look. The reasons are plain enough. The dealer would need to mount tires on the wheels, put the car on a hoist, remove the existing wheels and mount the new wheels, then put the car back on the ground. All of this would be done in the hope that the sometimes-fickle consumer likes the way the car looks. Not only does this require a substantial amount of employee time to mount the wheels, etc., but also mounting tires on custom wheels is not always an easy activity. Indeed, great skill and care are necessary to make sure that the wheels, and the tires that are mounted on them, are not damaged in the process. Wheel dealers are understandably disinclined to undertake such a process just to demonstrate how a car might look. They are, nonetheless, very familiar with the consumer's desire to see how a particular wheel looks on the car.

Given these limitations it is not surprising that wheel retailers do not customarily put wheels on a customer's car without selling the wheels first. The customer is thus left with a dilemma: the consumer must pick a style of wheel before a tire is mounted on the wheel, and before the wheel is installed on the consumer's car. Unless the consumer is absolutely confident that he or she will happy with the way that the wheels look on the car, the wheel selection decision is fraught with uncertainty and can thus be very difficult. The difficulty is only compounded by the fact that custom after-market wheels are generally a significant expense, and can even cost thousands of dollars.

There are various solutions that help mitigate these problems, but none that solve them. For instance, recognizing that consumer's like to see the appearance of a wheel on a car, some wheel manufacturers provide photographs of various makes of automobiles fitted with various styles of wheels. These photographs typically give a representative picture of how the particular wheels look on the car shown in the photograph. But unless the car shown in the photograph is the same make and the same color as the consumer's car, such photographs are a poor representation of the way that the consumer's car will look with those wheels. And as noted above, whether a wheel makes a consumer's car look the way the consumer wants is a very personal and subjective decision. Even if the car in a photograph were of the identical color and make as the consumer's car, the actual three-dimensional appearance of the consumer's car might be very different from the way it looks in a photograph. Indeed, in most instances the photographs supplied by wheel manufacturers are high quality professional shots. The way that a car looks in such photographs is likely very different from the way that the same car looks in a parking lot.

The World Wide Web has spawned another approach, albeit similar to the photographs just discussed. At the web site located at www.tirerack.com it is possible to view on a computer monitor the way that a selected make of car will appear with a selected style of wheel. More specifically, with the proper computer tools the online user of the web site may select a particular make and model of a car, and a particular car color from a drop-down list. An image of that car in the selected color appears on the screen with a corresponding set of images of custom wheels that are available for that car. The user then selects a particular wheel from the set of available wheels, and the image of the car then is regenerated with the selected wheels. This allows the viewer to see those wheels represented on the selected car. The user can browse through the wheels that are available for that particular car, and can print out the image of the car with the selected wheels.

While this online system allows a viewer to select a variety of car colors, and even to view a selected variety of wheels on the car, it suffers from the same basic problems as a simple photograph: it does not provide a three dimensional view of the user's car with the desired wheel. Again, stock images of cars represented on a two-dimensional computer monitor look very different from the way that the same car looks in the consumer's driveway, even if the color of the vehicle is the same.

Accordingly, there is a need for a system that allows consumers to visualize a realistic representation of custom wheels, as those wheels would appear on the consumer's car, as opposed to an image of a car. Such a system provides substantial benefits to the consumer and makes the purchasing decision much easier. And such a system is of great benefit to wheel manufacturers and to wheel dealers alike. With such a system manufacturers can allow consumers to "sample" all of the different wheel styles from a particular supplier. The dealer is able to show the consumer a realistic view of how that customer's car will look, without having to mount and dismount tires. In short, such a system is an effective sales tool at each point in the sales chain.

The present invention provides such a system. In one embodiment the invention uses high quality, full size graphic reproductions of actual wheel and tire combinations on a disc. Mobile stands hold a plurality of the discs, and each disc has a graphic reproduction of a wheel of a different style on each side. With a selected wheel disc in place on the mobile stand, the wheel disc is place next to the consumer's car such that the disc is positioned adjacent the car's actual wheel. The consumer may then view the selected wheel, as it would actually look on that consumer's car, and from any angle relative to the car. The disc system also functions as a point of purchase display for a selection of wheels in the tire dealer's showroom. In another embodiment tire rings that are graphic representations of actual tires are supplied with separable wheel discs, which are graphic representations of actual wheels. Each tire ring has an internal opening into which a wheel disc fits. The tire rings are supplied in a variety of outside diameters to match most commercial tire sizes; the size of the internal opening is constant. With this system the consumer selects a tire ring that matches the size tire that is mounted to his or her car. The tire ring is then "mounted" to the car's tire such that the tire ring lies adjacent the actual tire. The consumer then selects a wheel disc from a plurality of different discs and the selected disc is connected to the tire ring in the internal opening.

BRIEF DESCRIPTION 0F THE DRAWINGS

DETAILED DESCRIPTION OF PREFERRED EMBODIMENTS

Figure 1:
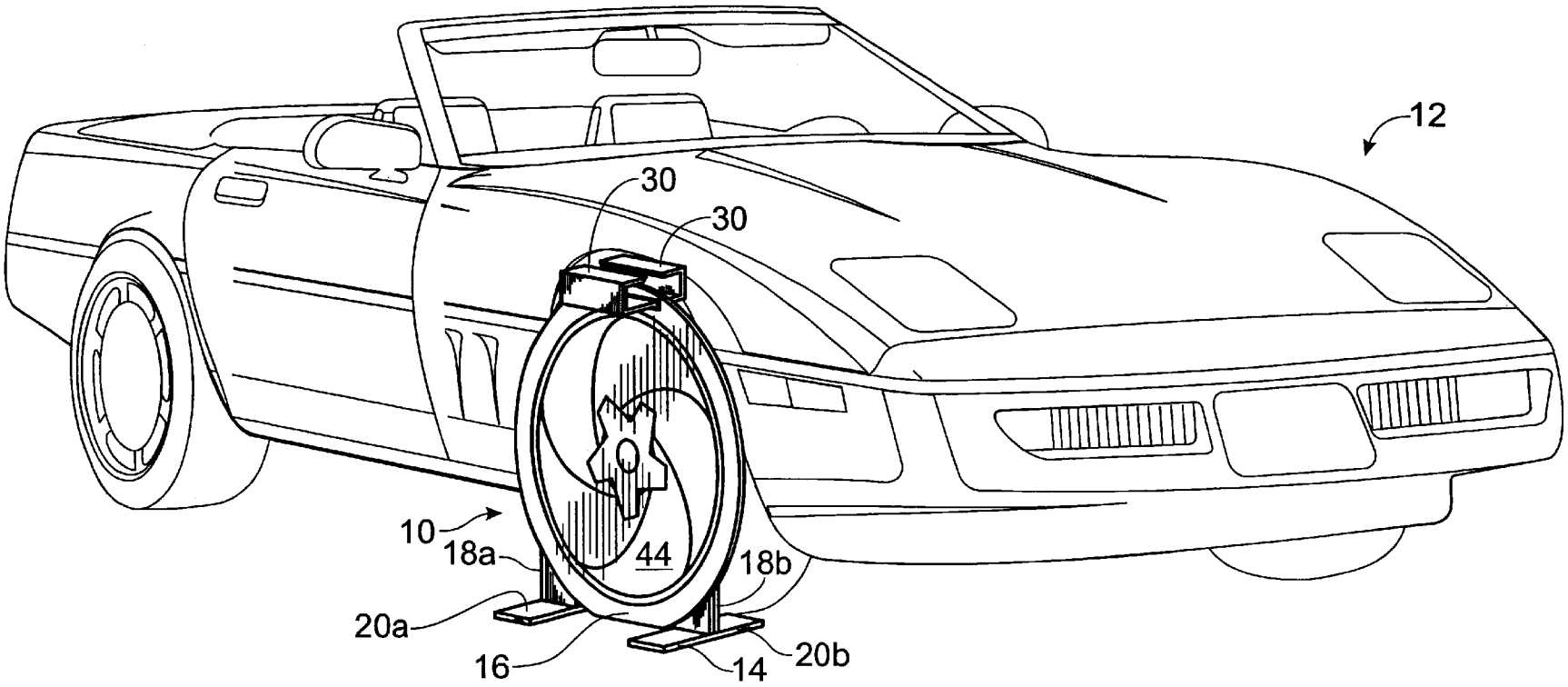
FIG. 1 is a perspective view of an automobile showing a preferred embodiment of the present invention used to simulate the appearance of a selected wheel style on the right-front wheel of the automobile.
Figure 2:
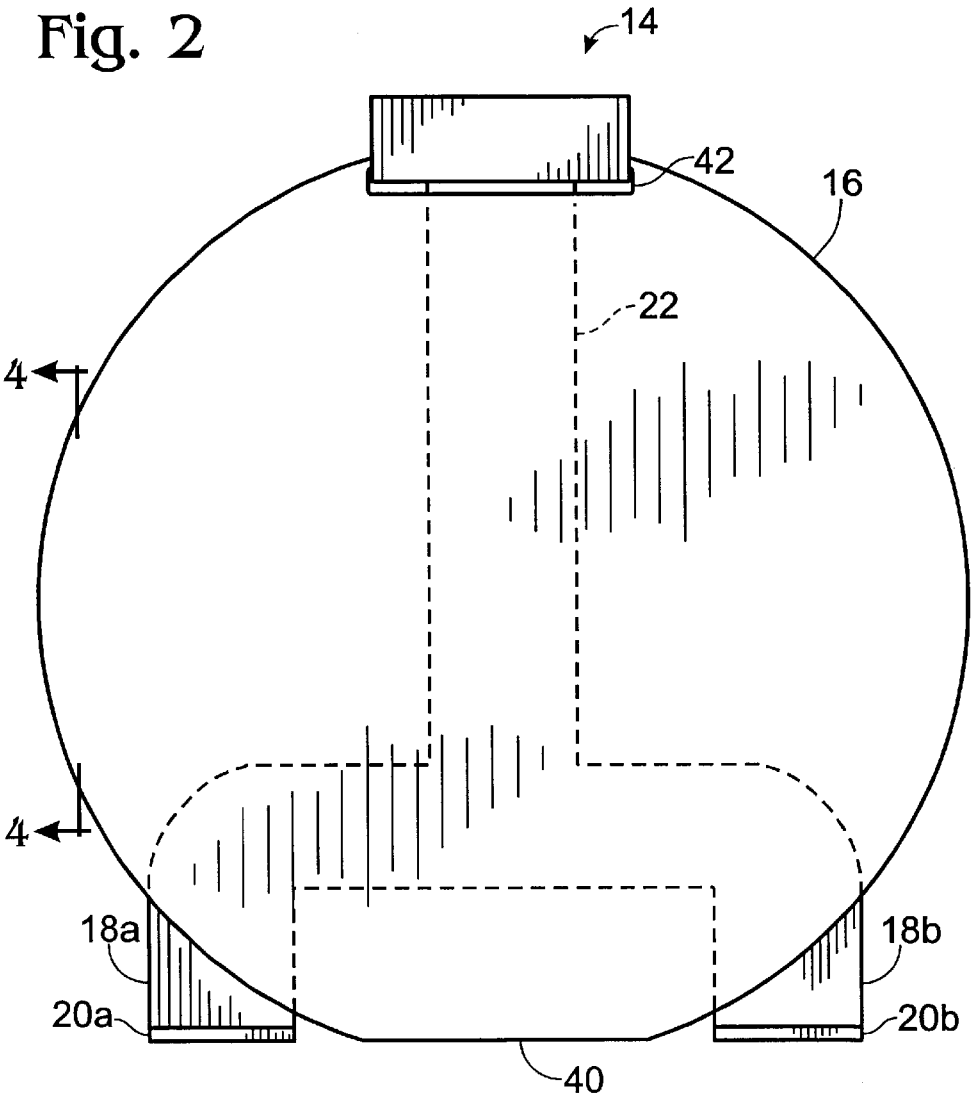
FIG. 2 is a front elevational view of the wheel simulator embodiment shown in FIG. 1 with a portion of support stand shown in phantom lines.
Figure 3:
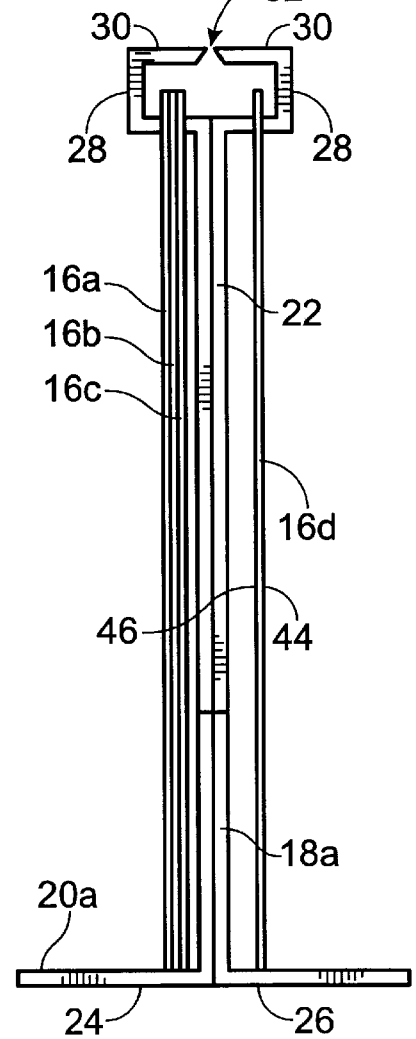
FIG. 3 is a side elevational view of the embodiment shown in FIG. 2 showing a plurality of wheel discs supported on the support stand.

A first preferred embodiment of a wheel simulator apparatus according to the present invention is shown in FIGS. 1 through 3. With reference to FIG. 1, the wheel simulator apparatus 10 is shown as it is used to simulate the way that a selected wheel will appear on an automobile 12. In FIG. 1 there is one wheel simulator apparatus 10, that is being used to simulate the appearance of a wheel on the right front of automobile 12. It will be appreciated that in many instances more than on wheel simulator apparatus 10 may be used with the automobile. While the description herein is made for ease of reference to automobile wheels, it will be understood that the present wheel simulator may be used with and is applicable to any wheel, including truck and trailer wheels.

Wheel simulator apparatus 10 includes a support stand 14, which holds a plurality of wheel discs 16. Referring to FIGS. 2 and 3 it may be seen that support stand 14 includes a pair of leg members 18*a* and 18*b* with feet 20*a* and 20*b* connected respectively thereto. Leg members 18*a* and 18*b* each curve upward and inward to meet at an upright frame member 22. In the preferred embodiment stand 14 is manufactured from a resilient yet lightweight vacuum formed plastic. The stand may be manufactured in a single piece, or more preferably, in two identical halves 24 and 26 that are mated together in a mirror image as shown in FIG. 3. When stand 14 is fabricated in this fashion the two halves 24 and 26 may be joined in any conventional manner, for instance with screws or bolts (not shown). By manufacturing the stand in two pieces the stand may be disassembled and broken down to facilitate shipping the unit in a smaller container.

Each of the two halves of stand 14 includes a "C" shaped handle portion 28 formed at the upper extent of upright frame member 22. When the two halves are assembled as shown in FIG. 3, the "open" sides of C-shaped handle portions 28 face inwardly toward one another to define an opening therebetween. The upper arm 30 of C-shaped handle portion 28 does not extend to the centerline between by the halves 24 and 26 where they are joined. Accordingly, when the two halves are assembled as shown in FIG. 3 with the upper arms 30 of the two halves 24 and 26 facing one another, a slot 32 is defined between the two upper arms. When thus assembled the C shaped handle portions combine to form a convenient handle for carrying the support stand, and as described below, serve as a hanger and guide for the wheel discs 16.

The support stand is configured to hold a plurality of wheel discs, each of which comprises a high quality graphic reproduction of a selected wheel style and an associated, mounted tire. The wheel discs are two-sided, with a reproduction of a different wheel style printed on each of the two sides of the disc.

Figure 4:
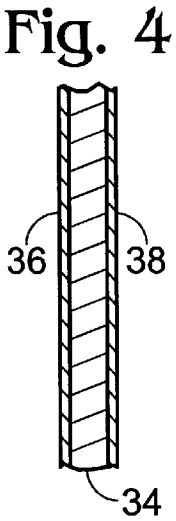
FIG. 4 is a cross sectional view of a portion of a wheel disc taken along the line 4—4 of FIG. 2.

For purposes of illustration, as shown in FIG. 3 the support stand 14 is supporting four wheel discs 16*a*, 16*b*, 16*c* and 16*d*. The support stand could hold any number of wheel discs. A cross sectional view of a portion of a wheel disc is shown in FIG. 4. Each wheel disc comprises a backing 34. A tire/wheel image is printed onto each side of the backing 34. Thus, a first tire/wheel image 36 is printed onto one side of backing 34 and a second tire/wheel image 38 is printed onto the opposite side of backing 34.

As seen in FIGS. 1 and 3, wheel disc 16 is circular except for a flattened portion 40 extending across the "bottom" side of the disc. Flattened portion 40 simulates the flattened portion of an actual pneumatic automobile tire that is bearing the weight of the automobile. Backing 34 is preferably a resilient lightweight material that will withstand moisture and harsh environmental conditions. Various types of plastic such as a styrene plastic blend work well for the backing. The backing is cut to a diameter that closely approximates the diameter of an actual automobile tire, for instance, approximately 25 inches in diameter. In the preferred embodiment, backing 34 is about 4 mm thick. As illustrated in FIG. 2, each disc has a slot 42 cut in the upper portion of the disc (opposite flattened portion 40). As detailed below, the discs are assembled with the stand such that the slot of each disc fits onto the C shaped portions 28, allowing the discs to be flipped over the stand so that each side of the disc may be displayed.

The tire/wheel images 36 and 38 are high quality reproductions of tires and wheels. The images are preferably formed from high quality photographs of tires and wheels, such as digital photographs. Digital photographs of a plurality of wheels are first generated. A corresponding digital image of a tire is then produced. These images are manipulated in a computer so that the tire image and the wheel image are sized so that they mate properly, as an actual tire mounted onto a wheel. The combined tire and wheel image is then manipulated so that it may be printed onto media that will be laminated to or printed on backing 34. In the embodiment shown in the drawings the tire/wheel images are silk-screened onto the backing. Silk screening, applied to the backing in known manners, generates a very high quality reproduction that has high resolution and good clarity. The images So produced are also quite resilient and are able to withstand harsh treatment and environments. Other methods of applying the tire/wheel image to the backing are also available, such as laser printed images on adhesive-backed vinyl. Thus, references herein to the process of "printing" a wheel image on the backing is a generic reference to any method of graphically reproducing on a backing material an image of a wheel and/or a tire.

A wheel/tire image is silk screened onto each side of the backing. Typically the wheel on each side of the backing will be of a different style.

Any number of wheel types from any number of wheel manufacturers may be represented in this manner, as may any number of tires. The primary goal of this invention is the simulation of wheels on specific automobiles. However, different brands of tires may also be digitally photographed and used with wheel images. Moreover, written indicia in the form of a wheel manufacturer's brand names or other promotional information may be printed on the "tires."

A plurality of wheel discs 16 prepared as described are then installed onto the support stand 14. As noted above, each disc has a slot 42 at the "upper" side of the disc. To assemble the wheel discs with the support stand, each wheel disc is inverted and inserted through slot 32 in the upper side of the support stand until slot 42 on the disc engages one of the two C shaped handle portions 28, as best illustrated in FIG. 3. The wheel disc may be flipped or rotated on the handle portions such that the handle portions act as a hanger for the disc. A plurality of wheel discs may be hung in this manner on the support stand. As noted above, four wheel discs 16 are shown in FIG. 3. Since each wheel disc has a tire/wheel image on each side, there are eight possible wheels that may be represented with the assembly of FIG. 3.

With reference to disc 16*d*, the first tire/wheel image labeled 44 on the first side of disc 16*d* is visible when the support stand is in the position shown in FIG. 1. However, the second tire/wheel image 46 on the second side of disc 16*d* would be made visible (as in FIG. 1), when disc 16*d* is flipped over the support stand into the position of disc 16*a* in FIG. 3.

Referring again to FIG. 1, the wheel simulator is used by first selecting from the plurality of wheel discs hung on the support stand the specific type of tire/wheel image that is a reproduction of the wheel that the customer is considering. In FIG. 1 that tire/wheel image is labeled 44. The wheel discs are flipped over the support stand to display the selected tire/wheel image. The support stand is then positioned adjacent the actual wheel of the car as shown in the figure. It is preferable to position the wheel disc as closely as possible to the car's tire and wheel to best simulate the selected tire/wheel image. To facilitate this preferred placement, the inwardly projecting portions of feet 20*a* and 20*b* straddle the car's tires, allowing the selected wheel disc to be placed adjacent and very near the car's tires, substantially obliterating the view of the actual wheel and tire. The customer may then walk around the car and visualize the appearance of the car with the selected wheel. Although the wheel discs are substantially planar, the high quality images of wheels reproduced on the discs provide the customer with an accurate representation of the way that the selected wheels will actually appear on that car.

Groups of wheel discs having logically associated tire/wheel images may be combined onto a support stand. For instance, if a given wheel manufacturer has one line of ten different wheels, a single support stand could be assembled with 5 wheel discs having images of those ten different wheels. Other logical groupings of tire/wheel image combinations from, for example, a single wheel supplier may be easily envisioned. Other groupings are possible as well. For instance, groupings of wire-style wheels from various manufacturers, groupings of off-road style wheels for sport utility vehicles, and so on.

The wheel discs may also be fabricated in various sizes to represent the sizes of wheels and tires normally mounted to the particular type of automobile with which the discs are being used. For instance, light truck and sport utility vehicles generally have larger wheels than small makes of cars. Thus, a set of wheel discs that have a larger Wheel and tire size may be used for such vehicles.

Alternate Embodiment

Figure 5:
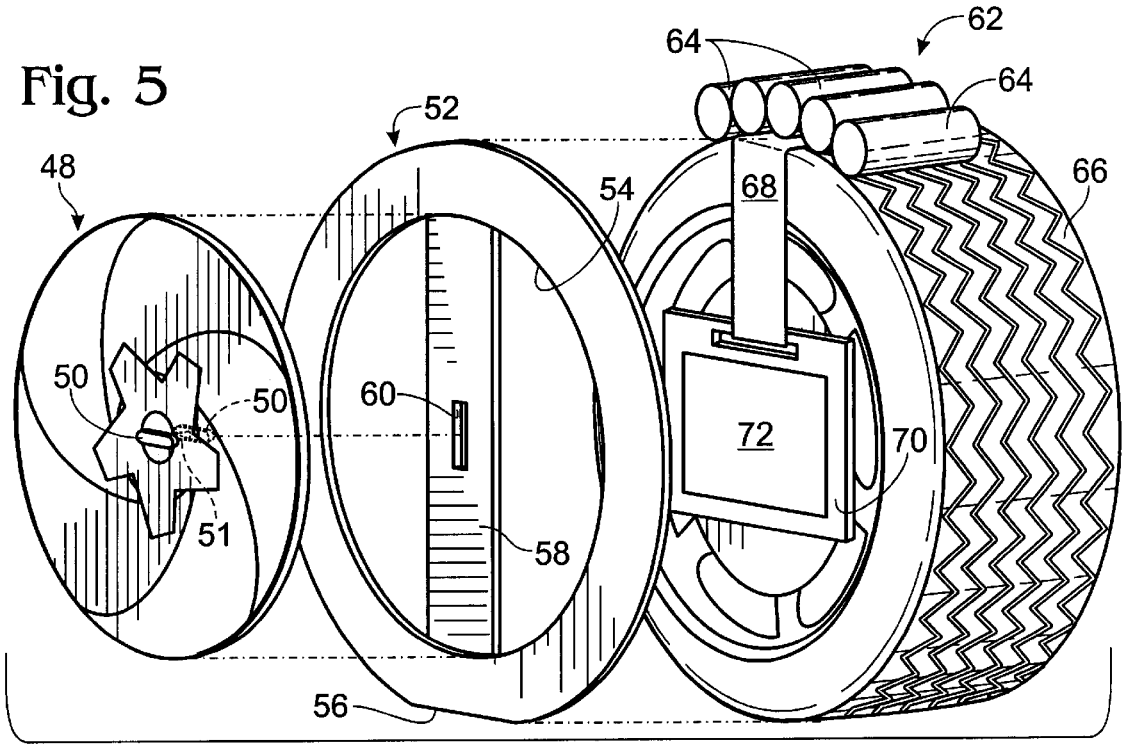
FIG. 5 is an exploded perspective view of an alternate embodiment of the wheel simulation apparatus of the present invention.

An alternative embodiment of a wheel simulation apparatus is illustrated in FIG. 5. The apparatus of the embodiment shown in FIG. 5 embodies the same conceptual approach to wheel simulation embodied in the embodiment described above. However, with the alternate embodiment the wheel image discs are separable from the tire ring discs, which are provided in a variety of different sizes to match the sizes of most tires used in automobiles.

A plurality of wheel discs 48 is provided. Each wheel disc is cut to an outer diameter of about 18 inches to match one standard size for actual custom wheels. Each wheel disc has a different style of commercially available wheel printed onto each side in the same manner as described above (i.e., applied to the disc with a silk screening process). Moreover, each wheel disc is fabricated from the same backing material as described above.

Wheel disc 48 has a lock mechanism that facilitates assembly of the wheel disc with a tire ring. The locking mechanism may take many different forms, but preferably comprises an elongate key 50 connected to each end of a rotatable key shaft 51 (shown in phantom lines in FIG. 5) that extends through a bore formed through the center of the wheel disc. The key shaft is longer than the thickness of the wheel disc so that there is a space between the key 50 and the adjacent surface of the wheel disc.

Wheel disc 48 is used with a tire ring 52, which is a graphic reproduction of a tire, produced in the manner described above. With the embodiment of FIG. 5 there are tire rings 52 provided in a variety of sizes, each of which however has a concentric opening 54 formed in the center of the ring. The concentric opening is the same size as the outer diameter of wheel disc 48.

The tire rings are fabricated in the same manner as the wheel discs 48, and include high quality graphic reproductions of actual tires. The tires may be generic (that is, without any written indicia indicating the manufacturer), or may include written indicia if desired, representing for example the manufacturer of the tire or the supplier of the wheels. To better simulate the appearance of an actual tire, the tire rings include a flattened portion 56 that represents the surface of the tire that rests on the ground when the tire is bearing the weight of the car.

The tire rings are sized so that they closely approximate the size and height of most available automotive tires. As an example, tire rings 52 may be provided in heights of 26, 28, 30, 32 inches, etc. The "height" is the length of a line extending at a right angle from the edge of the tire ring that rests on the ground that is, flattened portion 56—through the geometric center of the tire ring to opposite (or "upper") edge of the tire ring.

Only one side of the tire ring has a tire graphic printed on it. A strut 58 extends across opening 54 on the opposite side of the tire ring and is attached on both ends to the tire ring. The strut is typically made of the same material as the tire ring and the wheel discs. As described below, it serves as a support for the wheel discs. It also stabilizes the tire ring.

A keyhole opening 60 is formed in strut 58. Strut 58 is attached to tire ring 52 with the center point of opening 60 located in the geometric center of the tire ring. Opening 60 is cooperatively shaped to accept elongate key 50. A selected wheel disc 48 is assembled with a selected tire ring 52 by aligning elongate key 50 on disc 48 with opening 60 on tire ring 52. The key is inserted into the opening and is rotated about the axis of the key shaft so that the key engages the strut, securing the wheel disc in position on the tire ring. Strut 58 ensures that the wheel disc, which as noted above is sized to fit within opening 54, stays in the proper position on the tire ring. The assembled tire/wheel image is then ready for positioning adjacent the car's tire to simulate the appearance of the car with the selected wheel.

Figure 6:
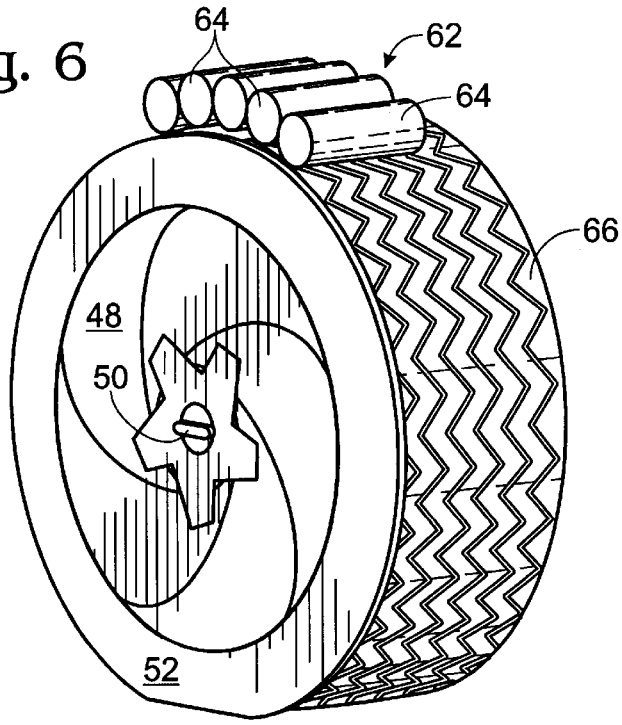
FIG. 6 is a perspective view of the embodiment shown in FIG. 5 with the wheel disc assembled with the tire ring, and the assembled simulation apparatus positioned adjacent an automobile tire.

A tire/wheel holder assembly 62 is provided to position the assembled tire and wheel simulator to the car's tire. Assembly 62 comprises a plurality of weights 64 that are interconnected in a manner that allows the weights to flex relative to one another. In the preferred embodiment weights 64 comprise cylindrical cloth bags filed with a heavy material such as sand or lead shot. The cylindrical bags are sewn together along their edges as shown in FIG. 5. This allows the bags to flex relative to one another such that the weights may be draped over the car tire 66, as shown with the weights conforming to the curvature of the tire. A nylon strap 68 is sewn to weights 64 and extends downwardly over the tire 66 toward the center of the wheel upon which tire 66 is mounted. A panel 70 is connected to the lower end of strap 68, and one portion of hook and eyelet material 72 is attached to the surface of panel 70 that faces away from tire 66. The cooperative portion of hook and eyelet material is attached to the inward-facing surface of strut 58 that faces tire 66 when the tire and wheel combination is attached to assembly 62. As shown in FIG. 6, the assembled tire and wheel combination is attached to assembly 62 by mating the hook and eyelet material on panel 70 to the cooperative hook and eyelet material on strut 58. The position of the tire and wheel relative to panel 70 is adjusted so that flattened portion 56 of tire ring 52 rests on the ground surface. With the appropriate size tire ring selected for the particular automobile, the customer may "try on" numerous styles of wheels to determine how they look on the customers car.

While the present invention has been described in terms of certain preferred embodiments and alternates, it is envisioned that certain equivalent structures could be substituted with equal effectiveness. For example, the disclosed tire/wheel holder assemblies and support stands could be replaced with any mechanical structure that functions to connect the assembled tire/wheel to a car's tire. Further, a wheel disc may be utilized without the disc including a representation of a tire. In this case, the selected wheel would be printed onto backing material in the manner described in detail above, omitting the tire portion of the wheel disc, and the wheel alone would be positioned adjacent the car's wheel to simulate the appearance of that selected wheel on the car. The wheel disc created in this manner could be positioned adjacent the car's wheel in either the manner depicted in FIGS. 1, 2 and 3, or the manner illustrated in FIG. 5.

It will thus be appreciated by one of ordinary skill that the spirit and scope of the invention is not limited to those embodiments described herein, but extend to the various modifications and equivalents as defined in the appended claims.

We claim:

1. A method of simulating the appearance of a selected wheel on an automobile having wheels and tires mounted thereon, comprising the steps of:

(a) creating a facsimile of a selected wheel with a tire mounted thereon, the size of the facsimile being approximately equal to the size of the wheels and tires mounted on said automobile;

(b) positioning said facsimile adjacent one of said wheels and tires mounted on said automobile in a position corresponding to the position of the wheel and tire mounted on said automobile.

2. The method of claim 1 wherein step (a) further comprises the steps of creating an image of said selected wheel, creating an image of a tire, and combining said selected wheel and tire images to create a combined image of a tire and selected wheel combination wherein the tire is mounted on said wheel.

3. The method of claim 2 including the step of printing said combined image on a backing material to generate said facsimile.

4. The method of claim 3 wherein a first combined image is printed on a first side of said backing material to generate a first side of said facsimile having a first selected wheel represented thereon, and including the step of printing a combined image of a second selected wheel and tire on a second side of said backing to generate a second side of said facsimile having a second selected wheel represented thereon.

5. The method of claim 1 including creating a plurality of said facsimiles, each of said plurality comprising a different selected wheel, and wherein step (b) further comprises selecting a facsimile from said plurality.

6. An automotive wheel simulator for simulating the appearance of a wheel mounted on an automobile having wheels and tires mounted thereon, comprising:

a wheel facsimile sized to approximate the size of the wheel mounted on said automobile, said wheel facsimile comprising a disc having a first and a second side and an image of a first selected wheel printed on said first side;

a support stand for supporting said wheel facsimile in a position adjacent the wheel mounted on said automobile to simulate the appearance of said first selected wheel on said automobile.

7. The automotive wheel simulator of claim 6 wherein said first side of said wheel facsimile includes an image of a tire mounted thereon to define a first wheel and tire combination facsimile, said first wheel and tire combination facsimile sized to simulate the size of the wheel and a tire mounted to said automobile.

8. The automotive wheel simulator of claim 6 including an image of a second selected wheel printed on said second side.

9. The automotive wheel simulator of claim 8 further including an image of a tire mounted to said second side to define a second wheel and tire combination facsimile, said second wheel and tire combination facsimile sized to simulate the size of the wheel and tire mounted to said automobile.

10. The automotive wheel simulator of claim 9 wherein the second selected wheel is different than said first selected wheel.

11. The automotive wheel simulator of claim 10 further comprising a plurality of wheel facsimiles, each having first wheel and tire combination facsimile on the first side and a second wheel and tire combination facsimile on the second side.

12. An automotive wheel simulator for simulating the appearance of a wheel mounted on an automobile having wheels and tires mounted thereon, comprising:

a wheel facsimile disc sized to approximate the size of the wheel mounted on said automobile, said wheel facsimile disc being substantially planar and having a first and a second side and an image of a first selected wheel printed on said first side;

wheel facsimile disc support means for supporting said wheel facsimile disc adjacent the wheel mounted on said automobile to thereby simulate the appearance of said first selected wheel on said automobile.

13. The wheel simulator of claim 12 wherein said wheel facsimile disc further comprises an image of a tire mounted to said first selected wheel.

14. The wheel simulator of claim 13 including an image of a second selected wheel and a tire printed on said second side.

15. The wheel simulator of claim 12 in which said wheel facsimile disc support means comprises a support stand having spaced apart legs, an upright frame member connected to said legs, and a wheel facsimile disc hanger for engaging a slot formed in said wheel facsimile disc.

16. The wheel simulator of claim 15 wherein said wheel facsimile disc hanger is configured for supporting a plurality of wheel facsimile discs, each of said discs having a slot formed therein for engaging said hanger.

* * * * *